US007444836B2

(12) United States Patent
Galligani

(10) Patent No.: US 7,444,836 B2
(45) Date of Patent: Nov. 4, 2008

(54) CLIP LINK FOR CHAINS AND CHAINS OBTAINED THEREWITH

(75) Inventor: Alano Daniele Galligani, Fucecchio (IT)

(73) Assignee: Ponsard Group LLC

( * ) Notice: Subject to any disclaimer, the term of this patent is extended or adjusted under 35 U.S.C. 154(b) by 134 days.

(21) Appl. No.: 11/326,324

(22) Filed: Jan. 6, 2006

(65) Prior Publication Data

US 2006/0179814 A1 Aug. 17, 2006

(30) Foreign Application Priority Data

Feb. 17, 2005 (IT) ..... AR20050002 U

(51) Int. Cl.
*A44C 5/02* (2006.01)
*F16G 13/00* (2006.01)

(52) U.S. Cl. ..... 63/38; 63/43; 63/4; 59/80; 59/82

(58) Field of Classification Search ..... 59/13, 59/15, 23, 27, 78, 80, 82, 84, 90, 91; 63/3, 63/3.1, 4, 7, 33, 37, 38
See application file for complete search history.

(56) References Cited

U.S. PATENT DOCUMENTS 330,214 A * 11/1885 Egge ..... 59/91
1,170,767 A * 2/1916 Lott ..... 59/80
1,376,866 A * 5/1921 Felger ..... 59/80
1,394,877 A * 10/1921 Wood ..... 59/80
1,605,077 A * 11/1926 Shelsey ..... 63/4
1,655,763 A * 1/1928 Fulford ..... 59/90
1,701,941 A * 2/1929 Allsopp ..... 59/91
1,810,590 A * 6/1931 Anderson ..... 59/80
RE18,230 E * 10/1931 Anderson ..... 59/80
1,931,124 A * 10/1933 Anderson ..... 59/80
1,939,806 A * 12/1933 Fassnacht et al. ..... 59/35.1
2,007,445 A * 7/1935 Goldenberg ..... 59/80
2,052,381 A * 8/1936 Chernow ..... 59/80
2,712,760 A * 7/1955 Patz et al. ..... 198/730
2,853,887 A * 9/1958 Johnson ..... 59/85

FOREIGN PATENT DOCUMENTS

GB 2 172 047 A * 9/1986

* cited by examiner

*Primary Examiner*—Robert J Sandy
*Assistant Examiner*—Ruth C Rodriguez
(74) *Attorney, Agent, or Firm*—Daniel S. Polley, P.A.

(57) ABSTRACT

A link with a first segment (3) of nearly constant width whereon near its free end (4) it has a transverse oblong slot (5), originating a bracket-shaped bridge (6), at the other end the segment (3) narrows and joins the second segment (8), which also has nearly constant width, smaller than the length of the slot (5) in the first segment (3), with the second segment (8) bent, towards its origin, in a position parallel to the first segment; the segments (3) and (8) having a length such as to leave between their approached free ends a space (13) that is a little greater than the thickness of the strip with which the link is manufactured.

20 Claims, 1 Drawing Sheet

CLIP LINK FOR CHAINS AND CHAINS OBTAINED THEREWITH

BACKGROUND OF THE INVENTION

The invention relates to a clip link for chains and to the chain obtained with a succession of such links, each link with open annular shape, with which to obtain ornamental items such as bracelets, key holders and other items provided with at least one chain segment.

In the ornamental field, known flexible thin structures are obtained with a succession of mutually concatenated components, obtained by pressing starting from a strip of metal.

In one case, i.e. the one illustrated in the Italian patent application AR98A000005, the structure is formed as a chain wherein the adjacent links are different from each other by twos, whereof one comprises two parts that are bent on their junction line until they overlap after encompassing the thin part of the other link which is constituted by an elongated pressed element formed by two half-shells with projecting teeth, also bent until the two half-shells are mutually superposed.

The two links lie on mutually normal planes, are different in the shape and, in a chain obtained therewith, the last link of the succession holds the links that precede it in the closed state and are concatenated to each other by twos and are capable of mutual rotations about the coupling axis.

This structure therefore appears as a succession of links of two types, one with toroidal structure, the other one shaped as a laterally flat barrel. It has no suitable surfaces to support decorations and fillings, it does not have a flat conformation so that, when it is used as a bracelet, it does not allow a uniform adherence to the wearer's body, and it may be subject to impacts that may cause its deformation and hence the loss of its aesthetic value.

In another case, the structure comprises a succession of mutually identical box components, each constituted by:

- a base with lateral edges and at least a junction bridge at one end;
- an open annular clip able to join the bridge of the component of the chain that precedes the one whereof the clip is a part;
- an internal spring able constantly to thrust the clip towards the resting state in which it closes in the upper part the base of the component whereof it is a part.

Such a structure is constructively complex. The application of a decorative addition on an element that composes it requires every time the detachment of said structure from the chain whereof it is a part as well as the separation of the elements that compose it, because otherwise the heating caused by the welding process with which the decorative additions are applied would lead to the destruction of the internal spring. The disassembly and re-assembly of the elements of each box component are relatively complex and not easy to perform by operators who are not particularly well trained.

The application of personalised ornaments by the final seller is therefore difficult and laborious.

SUMMARY OF THE INVENTION

The aim of the present invention is to provide a link with which a chain for ornamental items can be obtained, with such link being easy to manufacture and so structured that it enables to overcome the drawbacks of prior art solutions in the production of chains, and in particular:

- an object of the present invention is to provide a link with which a chain can be produced with nearly flat adhering surface, so it adheres to the wearer's body and it has no projecting elements subject to undergo deformations as a result of accidental impacts, or to become caught in parts of the wearer's clothing;
- another object is to provide a link that allows to manufacture chains, each constituted by a succession of mutually identical links, in order to simplify its production;
- a further object is to provide a link for chains having relatively ample surfaces, such as to allow the application thereon of ornaments, additions, or any other elements which may be useful to meet purchaser's requests;
- an additional object is to provide a link for chains that is structurally simple, free of springs and/or delicate parts, such as to allow its manipulation even by not particularly well qualified personnel, as could be the final sellers;
- yet a further object is to provide a link for chains that, on the surfaces to be adorned, can be subjected to heat sources, to allow the application on the surfaces of additions by welding, without damaging it;
- another object is to provide a link for chains that can be easily handled to link with others and constitute a chain with adjustable length.

These and other aims are achieved with the link of the present invention, thanks to its particular conformation and to the proportions of its parts, characterised in that it is constructed with a strip of rigid metal, such as steel, a first segment whereof has nearly constant width and, in its initial part, it is provided with a thin transverse slot originating a bracket bridge, at its end it narrows and joins the second segment, whose width is also nearly constant and smaller than the length of the slot in the first segment, with said second segment bent, until it assumes a position parallel to the first segment; the initial segment of said first segment is inflected towards the plane whereon the second segment lies, with said segments having such length as to leave between their approached free ends a distance greater than the thickness of the strip from which the link is obtained, but such as not to allow the passage of the bridge of a third link when two links, at such opening, are mutually concatenated and nearly aligned.

A chain obtained with a succession of such links is advantageous because the links, all mutually identical, have ample surfaces whereon additions can easily be applied or whereon inscriptions and/or superficial work processes can be executed.

It is advantageous because its links do not have springs or other elements that make it fragile or delicate with respect to work processes.

It is advantageous because it is a flat structure, thus capable of adhering to the wearer's body, without projections that would cause annoyance to the wearers, because said projections could become caught in their clothing or would be subject to accidental impacts with consequent aesthetically displeasing deformations.

It is advantageous because its links are easy to manufacture and, if obtained by pressing a sheet, they produce minimal scrap, thereby keeping manufacturing costs low.

It is advantageous because it is secure, i.e. its intermediate links cannot detach from the succession whereof they are a part.

It is advantageous because the concatenation of the links takes place by simple engagement of one over the other.

It is advantageous because a link can be detached and then reinserted by its plastic deformation, first by distancing its segments that face each other and then re-approaching them in calibrated manner.

BRIEF DESCRIPTION OF THE DRAWINGS

These and other advantages will be readily apparent, particularly to those skilled in the art, from reading the detailed description that follows, referred to the embodiment exemplified in the drawings of the accompanying table, in which.

DESCRIPTION OF THE PREFERRED EMBODIMENT(S)

Figure 1:
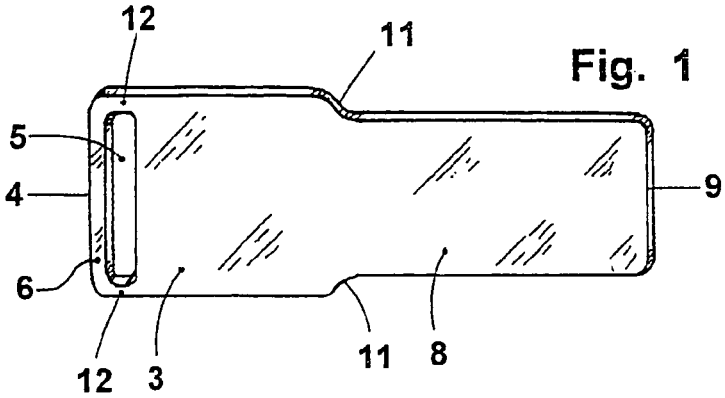
FIG. 1 is the axonometric view of the strip shaped in the profile from which the link is obtained.

The drawings are exemplifying in nature and their sole purpose is to facilitate the comprehension of the invention, without constituting any limitation therefor. Substantially, the invention thus relates to a link shaped like an open annular clip 1 and to the chain 2 obtained by concatenating a plurality of links 1 in mutual succession.

The clip link 1 is constituted by a strip of rigid metal, e.g. steel, normally obtained by pressing.

Said link is constituted by a first segment 3 with nearly constant width, provided in its initial part with a transverse slot 5. Said slot has the width greater than the thickness of the strip from which the link 1 is obtained and it is in such a position as to originate the bracket-shaped bridge 6.

At the other end, said first segment 3 narrows in the points 11 and joins the second segment 8 which is truncated at its free end 9. Said second segment 8 also has nearly constant width and anyway its amplitude is smaller than the length of said slot 5, so it can traverse and slide into the slot 5 of a second link 1 structurally identical to the one whereof it is a part.

Figure 2:
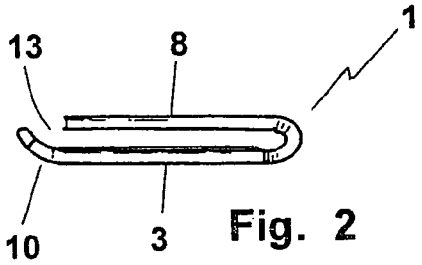
FIG. 2 is the side elevation view of the link obtained from shaping the metal strip of FIG. 1.
Figure 3:
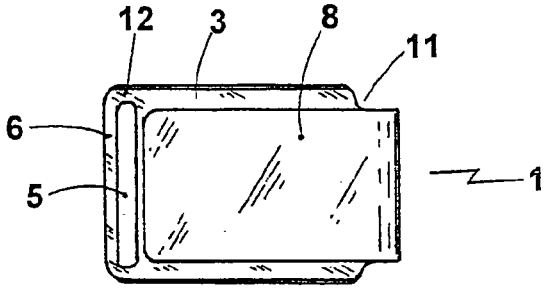
FIG. 3 is the front view of FIG. 2, from the side in which the narrower segment is positioned.
Figure 4:
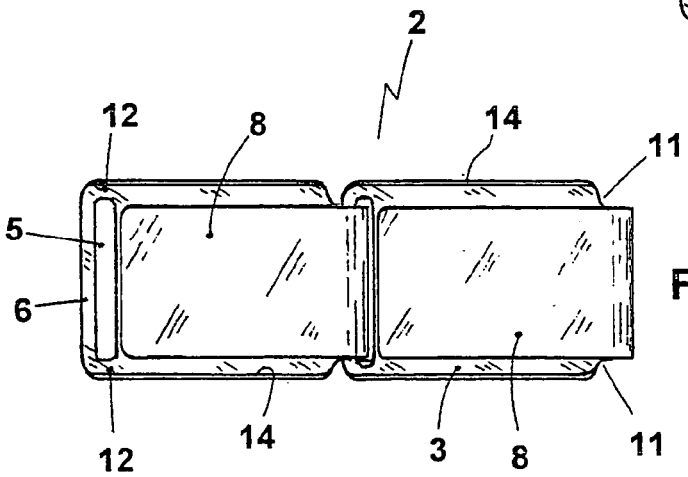
FIG. 4 is the front view of two mutually concatenated links constituting a chain.

Said second segment 8 is bent towards its origin and it assumes, after bending, a nearly parallel position to the first segment 3. The initial part 10 of said first segment 3, as better specified below, is inflected towards the plane whereon the second segment 8 lies, so that the starting strip 1 assumes a conformation resembling that of an open ring, as exemplified in FIG. 2.

Figure 5:
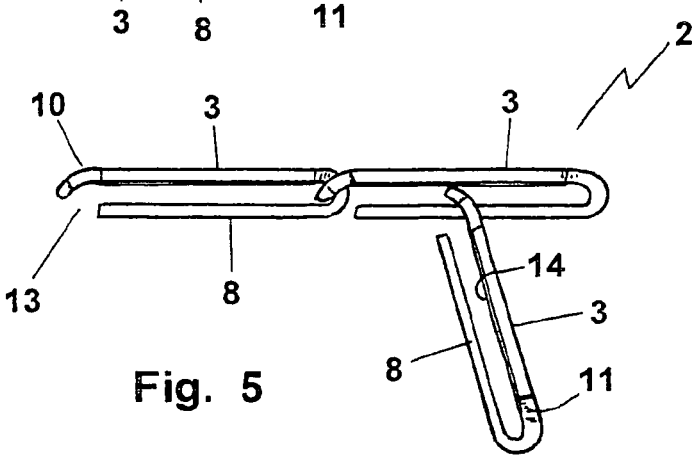
FIG. 5 is the side view of three mutually concatenated links, whereof the first two are in mutually aligned positions, the third one is in intermediate position on the second one, to highlight the impossibility of its detachment from said second link.

The first and the second segments of the link 1 have such length as to leave between their free ends 4 and 9 a space 13 whose amplitude is greater than the thickness of the bridge 6 in order to allow the concatenation of two links that are structurally identical to each other, but such as not to allow the passage of the bridge 6 of a third link when two links 1, at said opening 13, are mutually concatenated and nearly aligned, as exemplified in FIG. 5. The purpose for this is to prevent, in a chain 2 constituted by a succession of links 1, one of said links from sliding with its bridge 6 on the second segment 8 of the link that precedes it in the succession and becoming detached from said link, which would cause the chain to break in two parts.

The link of the invention is made of rigid material, such as not to inflect as a result of the normal stresses whereto it can be subjected in use. Therefore, the normal stresses transmitted by a bridge 6 of a link 1 to the second segment 8 of the link with which it is concatenated, must not cause the inflection of said second segment 8 so as to allow said bridge to traverse the space 13 in the presence of a concatenation between two links therein.

The suitable metal for this purpose can be steel and other metals or metal alloys with low flexibility.

In the preferred embodiment, the link 1 is obtained by pressing starting from a metal strip with thickness between 0.5 and 1.5 mm.

In the case of steel, the optimum thickness is of about 0.8 mm.

The junction 11 that joins the first segment 3 to the second segment 8 immediately precedes the beginning of the curving of the second segment, so that in the chain 2, produced with a plurality of links 1, the lateral legs 12 of the bridge 6 approach the edges that laterally delimit the first segment 3 of the adjacent link in the succession, so that the chain appears as a strip with nearly continuous lateral edges.

The curving of the initial part 10 of the first segment 3 of the link 1 starts at the origin of the legs 12 of the bridge 6, in such a way that said bridge is nearly coaxial with the centre of curvature of the second segment 8, in such a way that the first segments 3 of the links 1 mutually concatenated in the chain 2 tend to arrange themselves in a suspended chain, under the action of the weight of the individual links 1, in aligned positions.

To make the chain obtained with a succession of links 1 softer to the touch, the lateral edges 14 of the first segment 3 of each link 1 are usually slightly curved towards the plane whereon the corresponding second segment 8 of each link lies.

Similarly, the free ends 4 and 9 of the clip—with which the link 1 of the chain 2 is made—are truncated and have slightly rounded corners.

The chain 2 therefore is constituted by a succession of links 1 that are mutually identical in their functional structure.

On the contrary, the visible surfaces of the individual link 1 can be different from each other. They can be smooth, sandblasted, glazed or otherwise treated. They can bear incisions, settings or welded or otherwise fastened additions.

The chain 2 will thus be constituted by a succession of links 1 identical to each other in the shape, whilst their image may be different, since some may bear decorative additions and/or surface finishes.

Upon manufacturing, the details of the components may also change, without altering the functional logic of the invention, whose scope of protection is defined by the claims that follow.

The invention claimed is:

1. Clip link for chains, comprising: a strip of rigid metal having a thickness and a transverse slot, said transverse slot having a length, said strip having a first segment (3) and second segment (8), said first segment (3) with nearly constant width provided in its initial part with said transverse slot (5), in such a position as to originate a bridge (6) constituting a first free end of said first segment (3), a second other end of said first segment (3) narrows and joins the second segment (8), said second segment (8) with nearly constant width, smaller than the length of said slot (5) in the first segment (3), with said second segment (8) bent in a position that is nearly parallel to the first segment (3), the first free end is inflected towards a plane whereon said second segment (8) lies, with said segments (3) and (8) of a length such as to leave between their free ends (4) and (9) a space (13) a little greater than the thickness of the metal strip with which the link (1) is constructed in such a way as to allow concatenation of two links and not to allow the passage of the bridge (6) off a third link when two links, at said space (13), are mutually concatenated and nearly aligned; wherein in their bent relationship said first segment and said second segment define an open passageway therebetween and free of any sidewalls extending upward or downward from said first segment or said second segment.

2. Link, as claimed in claim 1, characterised in that said rigid metal is steel.

3. Link, as claimed in claim 1, characterised in said metal having a thickness normally ranging from 0.5 to 1.5 mm.

4. Link, as claimed in claim 1, wherein said strip constructed from steel with a thickness of about 0.8 mm.

5. Link, as claimed in claim 1, characterised in that the first segment (3) is joined to the second segment (8) at a junction (11) that is immediately before the beginning of a curving of said second segment (8).

6. Link, as claimed in claim 1, characterised in that curving towards the first free end (4) of the first segment (3) begins at an origin of the legs (12) of the bridge (6).

7. Link, as claimed in claim 1, characterised in that edges (14) that laterally delimit the first segment (3) are slightly curved towards the plane whereon the second segment (8) lies.

8. Link, as claimed in claim 1, characterised in that the first free end (4) of the first segment and a free end (9) of the second segment of the link from which the clip (1) is obtained are truncated and have slightly rounded corners.

9. Chain, constituted by links as claimed in claim 1, characterised by a succession of links (1) that are mutually identical in their functional structure.

10. Chain, as claimed in claim 9, characterised by a succession of links (1) that are identical to each other in shape.

11. Chain, as claimed in claim 9, characterised by a succession of links (1) that are structurally identical to each other, whereof some bear decorative additions and/or surface finishes.

12. Chain, as claimed in claim 11, wherein a decorative addition or surface finish of a first link in said succession of links is different in appearance than a decorative addition or surface finish of a second link in said succession of links.

13. Link, as claimed in claim 1, wherein the length of said transverse slot is nearly equivalent to a distance between a first edge of said first segment and a second edge of said first segment.

14. Link, as claimed in claim 1, wherein in a bent configuration a length of said second segment is more than 50% of a length of said first segment.

15. Link, as claimed in claim 1, wherein said second other end narrows inwardly at an angle such that said second segment is smaller in distance from a first edge to a second edge of said second segment as compared to a distance between a first edge and a second edge of said first segment.

16. A clip link for chains, wherein a plurality of clip links when secured together form a chain, said clip link comprising:

a strip of rigid material bent to form a first segment and a second segment;

said first segment having a free first end defining a transverse slot, said first segment having a first side edge and a second side edge, said first segment having a second end which narrows inwardly at an angle and contacts said second segment;

wherein in said bent configuration said second segment bent in a position that is nearly parallel to the first segment, wherein the free first end of said first segment is curved inwards towards a plane whereon said second segment lies, wherein a length of said first segment and a length of said second segment chosen such to define an area between the free end of said first segment and the free end of said second segment a little greater in size than a thickness of the strip as to allow concatenation of two links and not to allow the passage of a third link when two links are mutually concatenated and nearly aligned;

wherein in a bent configuration the length of said second segment is more than 50% of the length of said first segment.

17. The clip link of claim 16 wherein in their bent relationship said first segment and said second segment define an opening passageway therebetween and free of any sidewalls extending upward or downward from said first segment or said second segment.

18. The clip link of claim 16 wherein said transverse slot having a first end nearly extending to said first side edge of said first segment and a second end nearly extending to said second side edge of said first segment.

19. The clip link of claim 16 wherein said second end narrows inwardly at an angle such that said second segment is smaller in distance from a first edge to a second edge of said second segment as compared to a distance between a first edge and a second edge of said first segment based on the angle dimension.

20. A clip link for chains, wherein a plurality of clip links when secured together form a chain, said clip link comprising:

a strip of rigid material bent to form a first segment and a second segment;

said first segment having a free first end defining a transverse slot, said first segment having a first side edge and a second side edge, said first segment having a second end which narrows inwardly at an angle and contacts said second segment;

wherein in said bent configuration said second segment bent in a position that is nearly parallel to the first segment, wherein the free first end of said first segment is curved inward towards a plane whereon said second segment lies, wherein a length of said first segment and a length of said second segment chosen such to define an area between the free end of said first segment and the free end of said second segment a little greater in size than a thickness of the strip as to allow concatenation of two links and not to allow the passage of a third link when two links are mutually concatenated and nearly aligned;

wherein in a bent configuration the length of said second segment is more than 50% of the length of said first segment;

wherein in their bent relationship said first segment and said second segment define an open passageway therebetween and free of any sidewalls extending upward or downward from said first segment or said second segment;

wherein said transverse slot having a first end nearly extending to said first side edge of said first segment and a second end nearly extending to said second side edge of said first segment;

wherein said second end narrows inwardly at an angle such that said second segment is smaller in distance from a first edge to a second edge of said second segment as compared to a distance between a first edge and a second edge of said first segment based on the angle dimension.

* * * * *